US005193470A

United States Patent [19]

Raines

[11] Patent Number: 5,193,470

[45] Date of Patent: Mar. 16, 1993

[54] CORDING AND WORKPIECE HOLDER FOR AUTOMATIC STITCHING MACHINES

[75] Inventor: Max Raines, Salem, Mass.

[73] Assignee: British United Shoe Machinery Limited, Leicester, England

[21] Appl. No.: 790,202

[22] Filed: Nov. 7, 1991

[51] Int. Cl.[5] ..... D05B 31/00; D05B 39/00

[52] U.S. Cl. ..... 112/62; 112/121.15; 112/226.3; 112/266.1; 112/439

[58] Field of Search ..... 112/62, 115, 121.12, 112/121.15, 260, 262.3, 266.1, 306, 439, 28, 54; 38/102.2, 102, 102.1, 102.91; 269/47, 53, 54–54.5

[56] References Cited

U.S. PATENT DOCUMENTS

| | | | |
|---|---|---|---|
| 2,111,948 | 3/1938 | Squire | 112/439 X |
| 3,126,853 | 3/1964 | Maves | 112/266.1 X |
| 3,151,588 | 10/1964 | Wolkowitz | 112/439 X |
| 3,799,087 | 3/1974 | Beamish et al. | 112/121.15 X |
| 3,827,382 | 8/1974 | De Vita et al. | 112/262.3 |
| 4,587,910 | 5/1986 | Raines | 112/121.15 X |
| 4,719,863 | 1/1988 | Bisson | 112/121.15 X |
| 4,827,638 | 5/1989 | Peters | 38/102.2 |
| 5,081,944 | 1/1992 | Nakanishi | 112/121.15 X |

FOREIGN PATENT DOCUMENTS 0658439 10/1951 United Kingdom ..... 112/121.15

*Primary Examiner*—Andrew M. Falik
*Assistant Examiner*—Ismael Izaguirre

[57] ABSTRACT

A workpiece holder which is attachable to positioning apparatus associated with the sewing head of an automatic sewing machine whereby the workpiece holder can be automatically positioned with respect to an automatic reciprocating needle in the sewing head so as to allow a workpiece held within the workpiece holder to be sewn. The workpiece holder is adapted to hold cording to be disposed in the workpiece by stitching thereby to give a corded effect to the stitch pattern. The workpiece holder includes a base plate having at least one open stitch area being defined by edges within the base plate and arranged to hold a workpiece to be sewn. At least two rows of posts are disposed on the base plate, each of the rows being disposed adjacent to opposite edges of the stitch area. A cover plate is pivotally attached to the base plate. The cover plate has an open stitch area corresponding in location to the open stitch area on the base plate. An opening is formed in the cover plate to receive the rows of posts so the cover plate can be closed flatly upon the articles being worked upon. A mechanism is disposed on the base plate for attaching the base plate to the positioning apparatus of the automatic sewing machine.

11 Claims, 3 Drawing Sheets

CORDING AND WORKPIECE HOLDER FOR AUTOMATIC STITCHING MACHINES

BACKGROUND OF THE INVENTION

1. Field of the Invention

The present invention relates to workpiece holders for automatic stitching machines and in particular to the provision for mechanisms on the workpiece holders to hold cording for assembly by stitching of a vamp to give a desired decorative pattern effect.

2. Description of the Related Art

U.S. Pat. No. 3,988,993 to Brophy discloses a workpiece holding arrangement for use with automatic sewing machines. The workpiece holding arrangement involves a book pallet having hinged leaves that are used to orient and locate several pieces of work which are to be sewn together. Each leaf of the book pallet contains one or more cavities that orient and accurately register the pieces of work to be sewn with respect to each other. The book pallet is connected to a high resolution positioning system which accurately positions the piece of work relative to the reciprocating sewing needle of the sewing machine.

The U.S. Pat. No. 4,694,766 to Wickers et al, discloses a method and apparatus for registering and clamping the vamp portion of a boot relative to a flat boot shaft. The device provides for accurate registration of the boot vamp and enables the sewing without distorting folds.

U.S. Pat. No. 4,587,910 to Raines discloses a workpiece holding device for automatic sewing which includes a plurality of sharp pointed pins which extend upwardly from a base plate of a workpiece holding arrangement of a book pallet having hinged leaves. The workpiece holder of this patent provides for registration and clamping and does not require elaborate mechanisms to stretch and position the pieces that are to be sewn into accurate registration for automatic sewing.

SUMMARY OF THE INVENTION

The placement of decorative cording beneath a shoe vamp to give a required effect is well known to the art. In the manufacture of shoes and especially cowboy boots, artistic designs are sewn onto the vamp prior to lasting. Such designs include decorative swirls and can include an array of sewn parallel lines. Boots which have raised lines in the design between the parallel sewn lines have previously been made by boot makers. The common way to make the raised areas is to sew a fabric against the back of the leather vamp with the series of parallel sewn lines and after the parallel lines are sewn, a cord is manually threaded between the backing and the rear of the leather and between the parallel sewn lines. When the upper is made into a boot on a lasting machine the stretching will cause the cords to form decorative parallel raised areas. As can be realized, the requirement for manual threading of the cord significantly increases the cost of boot manufacture.

According to the present invention I have discovered that a workpiece holder which is attachable to the positioning apparatus associated with the sewing head of an automatic sewing machine. My workpiece holder is in the form of a book pallet with hinged leaves which support the workpiece and display the sewing area.

The workpiece holder includes a base plate having at least one open stitch area and preferably two. The stitch area is the form of matching openings in a cover plate and also in a base plate so as to enable a sewing needle to decoratively sew together a vamp and a fabric backing disposed beneath it. At least two rows of posts are disposed on the base plate with each of the rows being disposed adjacent to opposite edges of the stitch area. In operation, the fabric backing is placed over the stitch area and between the two rows of posts. A cord is wrapped back and forth between the two rows of posts and then tightly stretched between two anchor pins hold the cord in place. The vamp to be decoratively sewn is then placed over the cord and fabric backing and the cover is placed over the assembly and the cover plate is closed and locked into position for automatic stitching. The cords are sewn between parallel sewn lines which form a part of the decoration.

DESCRIPTION OF THE PREFERRED EMBODIMENTS

Figure 1:
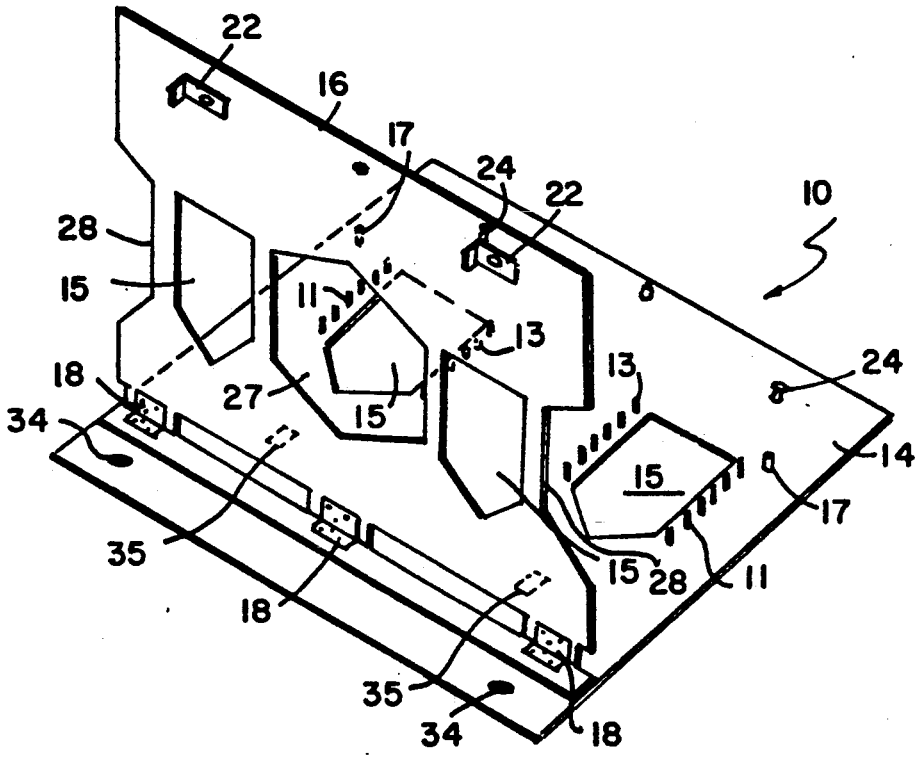
FIG. 1 is a perspective view of a workpiece holder in an open position with cording posts disposed on it.

Referring to FIG. 1, a workpiece holder 10 is illustrated in an open position. A cover plate 16 is pivotally attached by means of hinges 18 to a base plate 14. The cover plate 16 pivots downwardly over the base plate and is latched thereto by the pair of slidable latches 22 which engage posts 24. A pair of rows of cording posts 11 and 13 are disposed on the base plate 14 of both sides of a stitch area opening 15. In the embodiment shown, there are two stitch area openings 15 on the workpiece holder 10 with four rows of posts. Each of the stitch area openings 15 has a pentagonal shape and is formed in both the base plate 14 and the cover plate 16. A pair of registration holes 34 are disposed adjacent the edge of the base member 14 to provide for attaching the workpiece holder to an automatic sewing machine.

The posts arranged as outer row 11 and inner row 13 are closely spaced (about 2.5 mm. apart which is just about the diameter of the cord) and extend upwardly from the base plate 14 about 1 cm. In the embodiment shown 6 posts are illustrated but the number is not critical so long as an adequate number are provided to arrange the cording. The essential point in the arrangement of the posts is that one of the posts of inner row 13 is disposed relative to a post of the adjacent outer row 11 so that parallel lines of cording can be disposed between them. A cord anchor pin 17 is disposed on one side of the base plate 14 and another cord anchor pin 17 is disposed on the other side.

Figure 2:
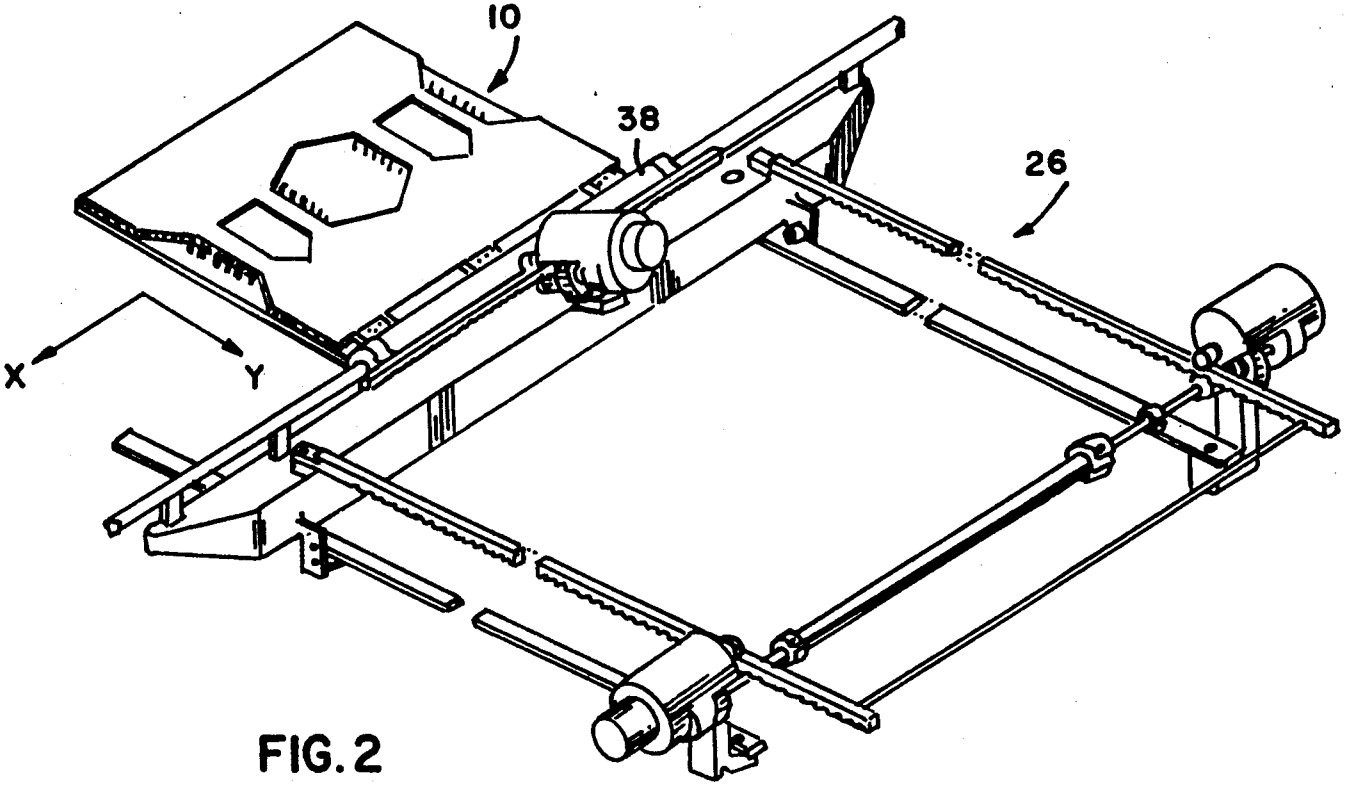
FIG. 2 is a view of the workpiece holder of FIG. 1 connected to a positioning apparatus of an automatic sewing machine.

Referring to FIG. 2 the workpiece holder 10 is generally illustrated relative to a positioning apparatus 26 of an automatic sewing machine. The positioning apparatus includes a moveable carriage 28 which receives the workpiece holder 10. As shown in FIG. 1 the workpiece holder 10 has a pair of registration holes 34 which are locatable upon registration posts disposed on the moveable carriage 28. The workpiece holder 10 is secured to carriage 28 by convenient means such as clamps or bolts.

The workpiece holder 10 is shown disposed in a plane defined by the carriage 30 and the bed (not shown) of the automatic sewing machine. The workpiece holder 10 is moveable in the indicated X and Y directions by a positioning apparatus so as to present the workpiece under a reciprocating sewing needle at known locations. Accurate sewing of the workpiece also requires accurate registration of the workpiece within the workpiece holder 10. Moreover, accurate disposition of the cords that are sewn beneath the workpiece for decorative effect also requires accurate positioning of the rows of posts 11 and 13 relative to each other on the sides of the stitch area opening 15.

Figure 3:
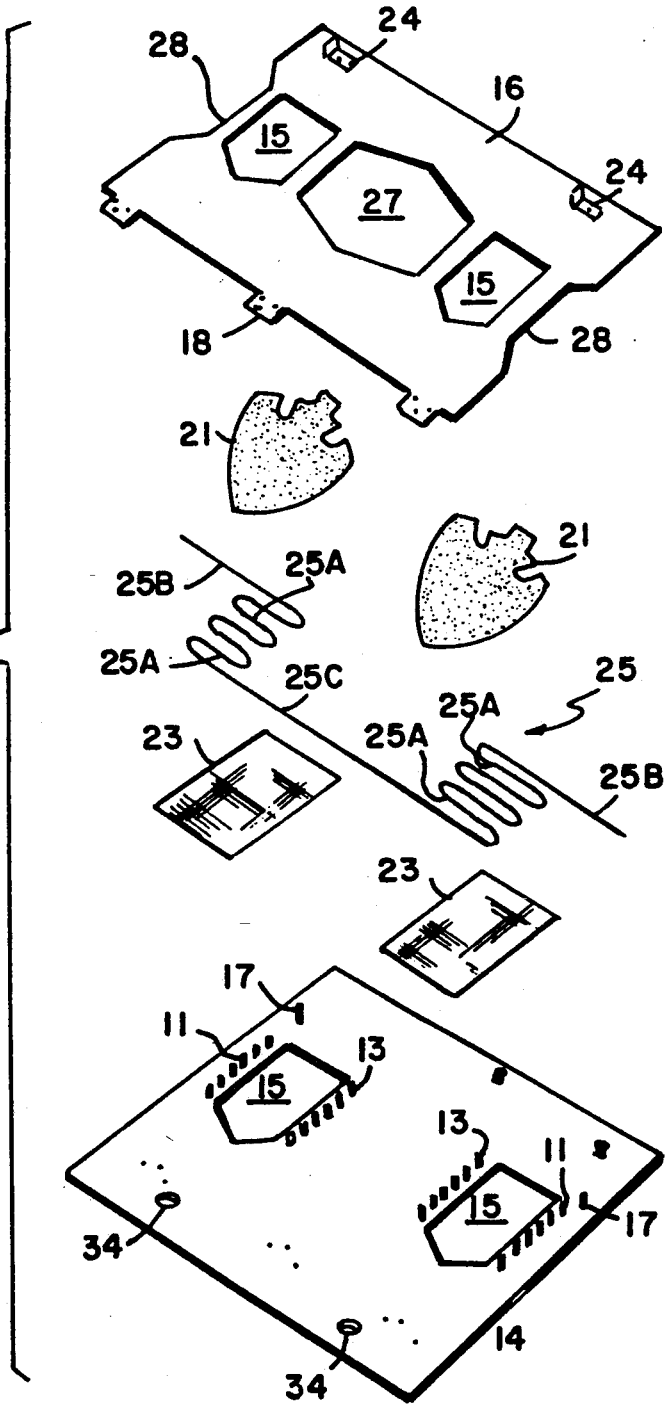
FIG. 3 is an exploded view of the workpiece holder and workpiece.

Accurate registration and holding of a workpiece (in this case a vamp for a cowboy boot) within the workpiece holder 10 will now be explained relative to FIG. 3. FIG. 3 is an exploded view of both the workpiece holder and the workpiece 21. The workpiece 21 includes a square of fabric 23 and a cord set 25 which has been looped around the rows of posts 11 and 13 on opposite sides of base plate 14 and stretched tautly between anchor pins 17 so as to form rungs 25A disposed parallel to each other. A pair of ends 25B extend from the rungs 25A and these ends are wrapped about cord anchor pins 17. An intermediate section 25C is disposed between sets of the rungs 25A to join them together and provide for cording and decorating two workpieces in a single sewing operation.

A vamp 21 for a cowboy boot to be decoratively stitched is laid upon the cord sets 25 overlaying the parallel wrapped cords 25A and the fabric layer 23 with the tip abuting stop 35. The assembly of the fabric layer 23, the cord set 25 and the vamp 21 is sandwiched between the base plate 14 and the cover plate 16 with the vamp 21 showing from stitch area openings 15. The cover 16 is flatly disposed upon the base 14.

In the embodiment shown, two stitching area openings 15 are shown with a vamp 21 disposed upon each. The outer rows of posts 11 are disposed between an outer edge of the base plate 14 and the stitch area 15. The inner rows of posts 13 are disposed adjacent the inner edges of the stitch area opening 15. The rows 11 and 13 are parallel to each other and the posts of one row are at right angles to a post of the other row whereby a series of straight lines of cords can be formed over each of stitch area openings 15 in a rung-like shape.

A central material clearance area 27 in the shape of a hexagonal cavity is disposed on the cover plate 16 and is arranged so as to receive the inner rows of posts 13. A pair of side clearance areas 28 formed by cavities in the sides of the cover plate 16 are shaped to receive the outer rows of posts 11. In this way, the cover 16 can be closed flatly upon the base plate 14 over the workpieces and the cord to enable the use of the workpiece holder automatic stitching machine. The shape of the central material clearance areas 27 and the side material clearance areas 28 is not critical so long as they are shaped to enable the user to flatly lay the cover 16 on the base 14. In this way, the rows of posts 11 and 13 will extend through the cover plate so that they can be seen.

In the preferred operation, a pair of fabric backing members 23 are laid over the stitching area openings 15 a cord 25 is attached to the cord anchor pin 17 and passed beneath the uppermost of the outer cording posts 11 and stretched over to the uppermost of the inner row of cording posts 13. The cord is then passed around the next adjacent cording post therebeneath and stretched over the stitch area opening 15. The operation is continued until the desired cording rows are made. The cording is then stretched to the other stitch area opening on the cover plate and its wrapping is continued again until the desired effect is provided. When the cord has been wrapped around the post 11 and 13 on both sides of the base plate 14 it is tightly stretched and then wrapped around the cording anchor pin 17. A vamp is then placed over the cording assembly and the cover plate 16 is locked in place with locks 24 and then placed on the carriage of the automatic sewing machine with holes 34 serving for guidance.

The needle of the automatic sewing machine then provides the decorative design and also sews a series of parallel straight lines which encase the cord between parallel stitches. The workpiece holder can then be removed from the automatic stitching machine and the cover plate can be lifted to show the sewn and corded vamps. The vamps are removed from the base plate and the looped ends of the cords can be cut to enable the manufacturer of the boot to place the corded vamp on a lasting machine for subsequent manufacture of the boot.

It is apparent that modifications and changes can be made within the spirit and scope of the present invention but it is my intention, however, only to be limited by the scope of the appended claims.

As my invention I claim

1. A workpiece holder attachable to a positioning apparatus co-acting with a sewing head of an automatic sewing machine, the workpiece holder being automatically positioned with respect to an automatic reciprocating needle in the sewing head so that a workpiece held within the workpiece holder is sewn, said workpiece holder having means for holding cording for forming part of a stitch pattern to thereby provide a corded effect to the stitch pattern, said workpiece holder comprising:

a base plate for holding said workpiece to be sewn, said base plate having at least one open stitch area, said stitch area being defined by edges within said base plate;

said cording holding means includes at least two rows of posts disposed on said base plate, each of said rows being disposed adjacent to opposite edges of said stitch area, the posts of one row being positioned relative to those in another row so that a length of cord is held in parallel straight lines across said stitch area;

a cover plate pivotally attached to said base plate, said cover plate having at least one open stitch area corresponding in location to the open stitch area on said base plate;

openings disposed on said cover plate, for receiving said rows of posts whereby said cover plate is closable flatly upon the workpiece being worked upon;

means on said base plate for attaching said base plate to the positioning apparatus of the automatic sewing machine.

2. The workpiece holder according to claim 1 wherein the posts of one row are disposed relative to the posts of the other row such that a post of said one row is at a right angle to said other row of posts.

3. The workpiece holder according to claim 2 wherein there are two open stitch areas disposed on said cover plate and two corresponding open stitch areas are disposed on said base plate.

4. The workpiece holder according to claim 1 wherein there are two open stitch areas on said cover plate and base plate, said stitch areas on the base plate being spaced from each other and each having one row of posts disposed on each side and said openings are disposed adjacent said stitch areas on said cover plate so as to receive corresponding rows of posts.

5. The workpiece holder according to claim 1 further including means disposed on said base plate to anchor said cording prior to wrapping said cord about said posts to stretch said cord tightly over said open stitch area.

6. The workpiece holder according to claim 5 further including a second means to anchor said cording on said base plate after said wrapping and stretching of said cording.

7. The workpiece holder according to claim 6 wherein at least one of said anchor means is a pin means to receive and hold said cord during the stitching operation.

8. A workpiece holder attachable to a positioning apparatus co-acting with a sewing head of an automatic sewing machine, the workpiece holder being automatically positioned with respect to a reciprocating needle in the sewing head so that a workpiece held within the workpiece holder is sewn, said work piece holder comprising:

a base plate;

at least one stitch area disposed in said base plate, said stitch area being an aperture formed in said base plate;

means for receiving cord for decoration of the workpiece to be stitched, said cord being disposed between an underlay and a vamp of a shoe, said cord receiving means being disposed on sides of said stitch area and being positioned in straight line rows and portions of said cord receiving means on one side of said stitch area being at right angles to portions of said cord receiving means on another side of said stitch area, said cord receiving means receiving a length of cord to be wrapped therearound in parallel straight lines across said open stitch area;

a cover plate pivotally attached to said base plate, said cover plate having at least one stitch area corresponding in location to said at least one stitch area on said base plate whereby said cover plate closes flatly on the workpiece being worked upon;

clearance means on said cover plate provided so that said cover plate closes flatly over said workpiece and said cord receiving means.

9. The workpiece holder according to claim 8 further including means disposed on said base plate to anchor said cording prior to wrapping said cord about said cord receiving means whereby to stretch said cord tightly over said open stitch area.

10. The workpiece holder according to claim 9 further including a second means to anchor said cording on said base plate after said wrapping and stretching of said cording.

11. The workpiece holder according to claim 8 wherein there are two open stitch areas on said cover plate and base plate, said stitch areas on the base plate being spaced from each other and each having one row of posts disposed on each side and said openings are disposed adjacent said stitch areas on said cover plate so as to receive corresponding rows of posts.

* * * * *